US007507112B2

(12) United States Patent
Mundt

(10) Patent No.: US 7,507,112 B2
(45) Date of Patent: Mar. 24, 2009

(54) LOW INSERTION FORCE CONNECTOR COUPLING

(75) Inventor: Kevin Mundt, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 11/609,059

(22) Filed: Dec. 11, 2006

(65) Prior Publication Data

US 2008/0137277 A1 Jun. 12, 2008

(51) Int. Cl.
*H01R 12/24* (2006.01)

(52) U.S. Cl. ..... 439/495; 439/357

(58) Field of Classification Search ..... 439/357, 439/358, 495

See application file for complete search history.

(56) References Cited

U.S. PATENT DOCUMENTS 6,036,509 A 3/2000 Maejima
6,089,905 A * 7/2000 Shimmyo et al. ..... 439/495
6,347,946 B1 * 2/2002 Trobough et al. ..... 439/70
6,382,991 B2 5/2002 Kumakura et al.
7,094,090 B2 8/2006 He et al.
7,134,891 B2 * 11/2006 Kayama et al. ..... 439/260
7,255,584 B2 * 8/2007 Takashita ..... 439/260

* cited by examiner

*Primary Examiner*—Tho D Ta
*Assistant Examiner*—Travis Chambers
(74) *Attorney, Agent, or Firm*—Haynes and Boone, LLP

(57) ABSTRACT

A low insertion force connector coupling apparatus includes a low insertion force connector body. A cable channel is defined by the low insertion force connector body. A plurality of low insertion force connector contact members are located on the low insertion force connector body adjacent to the cable channel. A cable securing member is located adjacent the cable channel and is operable to engage a cable coupling member on a cable such that a plurality of flat flexible cable contact members on the cable may not be disengaged from the plurality of low insertion force connector contact members without disengagement of the first cable securing member and the cable coupling member.

18 Claims, 8 Drawing Sheets

LOW INSERTION FORCE CONNECTOR COUPLING

BACKGROUND

The present disclosure relates generally to information handling systems, and more particularly to a low insertion force connector coupling for an information handling system.

As the value and use of information continues to increase, individuals and businesses seek additional ways to process and store information. One option is an information handling system (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

Some IHSs utilize flat and flexible wires for coupling subsystems together. IHSs such as, for example, notebook computers, often utilize wires known as flat flexible cables (FFC). FFCs are typically coupled to an IHS with a low insertion force (LIF) connector. Conventionally, a LIF connector relies on the friction between the electrical contacts to keep the FFC coupled to the IHS. Thus, the insertion force required to couple the FFC to the IHS is proportional to the retention force between the electrical contacts. As the insertion force is reduced, the retention force is also reduced resulting in an increased likelihood that the FFC will become disconnected. When the FFC becomes disconnected, a factory failure or a latent customer failure occurs, which increases costs and results in a poor customer experience.

Accordingly, it would be desirable to provide an LIF connector coupling absent the disadvantages found in the prior methods discussed above.

SUMMARY

According to one embodiment, an LIF connector coupling apparatus includes a LIF connector body, a cable channel defined by the LIF connector body, a plurality of LIF connector contact members located on the LIF connector body adjacent to the cable channel, and a first cable securing member located adjacent the cable channel and operable to engage a cable coupling member on a cable such that a plurality of FFC contact members on the cable may not be disengaged from the plurality of LIF connector contact members without disengagement of the first cable securing member and the cable coupling member.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
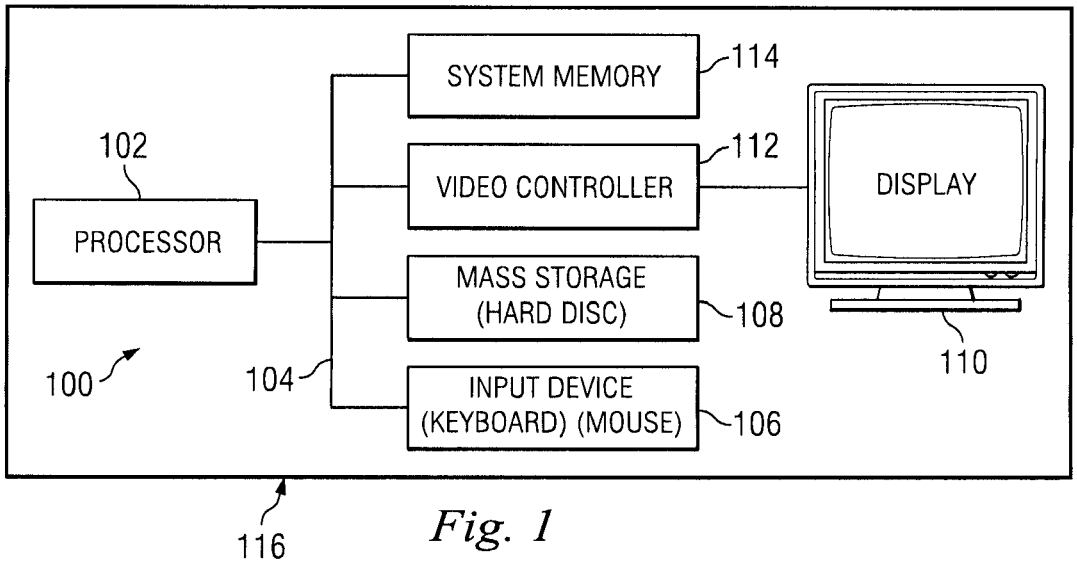
FIG. 1 is a schematic view illustrating an embodiment of an IHS.

In one embodiment, IHS 100, FIG. 1, includes a processor 102, which is connected to a bus 104. Bus 104 serves as a connection between processor 102 and other components of computer system 100. An input device 106 is coupled to processor 102 to provide input to processor 102. Examples of input devices include keyboards, touch screens, and pointing devices such as mouses, trackballs and trackpads. Programs and data are stored on a mass storage device 108, which is coupled to processor 102. Mass storage devices include such devices as hard disks, optical disks, magneto-optical drives, floppy drives and the like. IHS 100 further includes a display 110, which is coupled to processor 102 by a video controller 112. A system memory 114 is coupled to processor 102 to provide the processor with fast storage to facilitate execution of computer programs by processor 102. In an embodiment, a chassis 116 houses some or all of the components of IHS 100. It should be understood that other buses and intermediate circuits can be deployed between the components described above and processor 102 to facilitate interconnection between the components and the processor 102.

Figure 2A:
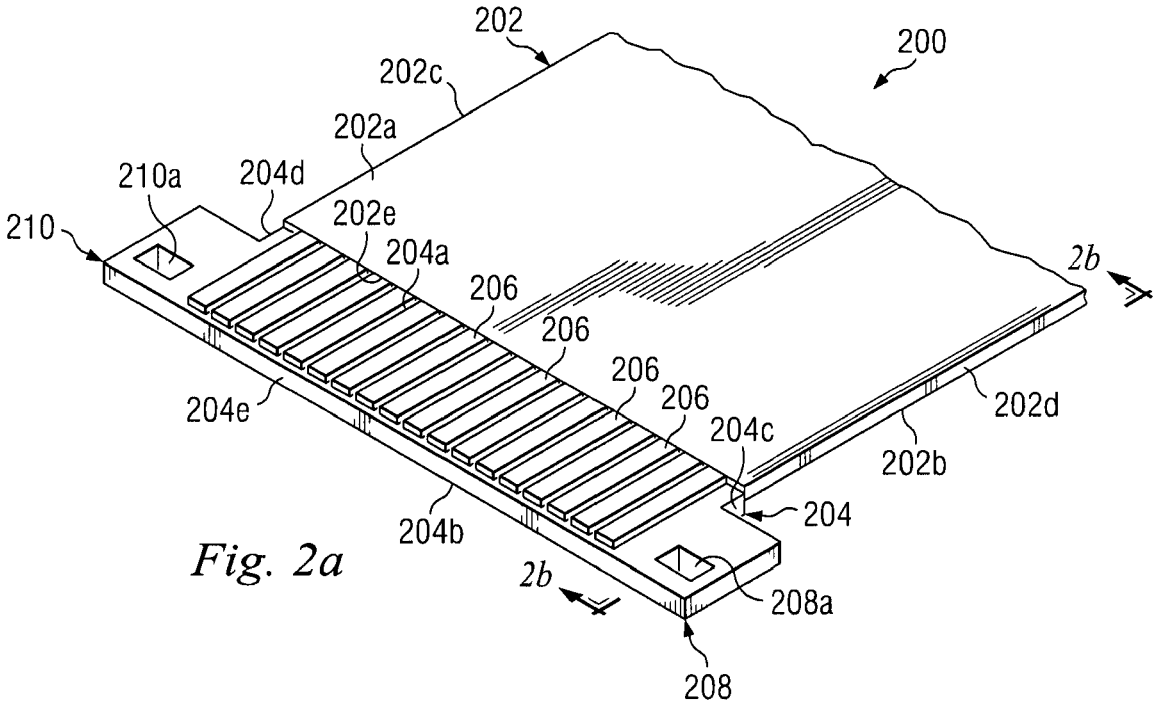
FIG. 2*a* is a perspective view illustrating an embodiment of a cable.
Figure 2B:
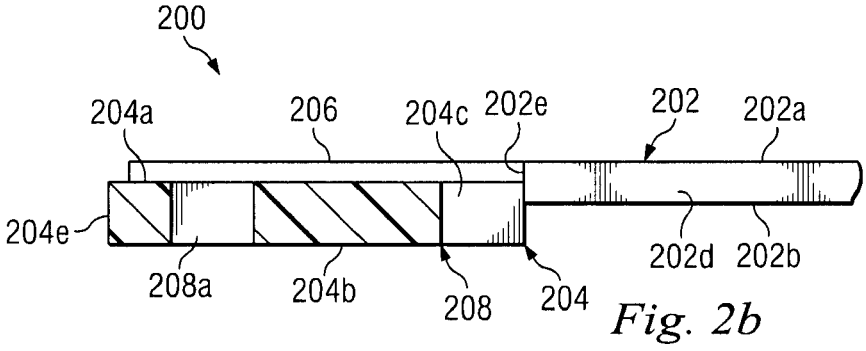
FIG. 2*b* is a cross sectional view illustrating an embodiment of the cable of FIG. 2*a*.

Referring now to FIGS. 2*a* and 2*b*, a cable 200 is illustrated. In an embodiment, the cable 200 may be a flat flexible cable known in the art, as illustrated, or a variety of other types of cables that are capable of coupling subsystems together. The cable 200 includes a flat flexible cable 202 having a top surface 202*a*, a bottom surface 202*b* located opposite the top surface 202*a*, a pair of opposing side edges 202*c* and 202*d* extending between the top surface 202*a* and the bottom surface 202*b*, and a distal end 202*e* extending between the top surface 202*a*, the bottom surface 202*b*, and the side edges 202*c* and 202*d*. A substrate 204 is coupled to the distal end 202*e* of the FFC 202. The substrate 204 includes a top surface 204*a*, a bottom surface 204*b* located opposite the top surface 204*a*, a pair of opposing side edges 204*c* and 204*d* extending between the top surface 204*a* and the bottom surface 204*b*, and a front edge 204*e* extending between the top surface 202*a*, the bottom surface 202*b*, and the side edges 204*c* and 204*d*.

In an embodiment, a plurality of FFC contact members 206 are located on the top surface 204*a* of substrate 204 in a substantially parallel and spaced apart orientation from each other and between the pair of opposing side edges 204*c* and 204*d*, as illustrated. In an embodiment, the plurality of FFC contact members 206 are coupled to wires that are located in the FFC 202. The plurality of FFC contact members 206 may be located in different positions other than what is illustrated such as, for example, on the bottom surface 204*b* of the substrate 204 in a substantially parallel and spaced apart orientation from each other between the pair of opposing side edges 204*c* and 204*d*, or on the front edge 204*e* of the substrate 204 in a substantially parallel and spaced apart orientation from each other between the pair of opposing side edges 204*c* and 204*d*.

A first cable coupling member 208 extends from the side edge 204*c* of the substrate 204 adjacent the front edge 204*e* and defines a first aperture 208*a* extending through the first cable coupling member 208. While the first aperture 208*a* is illustrated as hole that extends all of the way through the first cable coupling member 208, in an embodiment the first cable coupling member 208 may define a channel that does not extend all of the way through the first cable coupling member 208. A second cable coupling member 210 extends from the side edge 204*d* of the substrate 204 adjacent the front edge 204*e* of the substrate 204, is located on an opposite side of the plurality of FFC contact members 206 from the first cable coupling member 208, and defines a second aperture 210*a* extending through the second cable coupling member 210. While the second aperture 210*a* is illustrated as a hole that extends all of the way through the second cable coupling member 210, in an embodiment the second cable coupling member 210 may define a channel that does not extend all of the way through the second cable coupling member 210. Although two cable coupling members are illustrated, in an embodiment there may be only the first cable coupling member 208. In an embodiment, the first cable coupling member 208 may be located in different positions other than what is illustrated such as, for example, between two of the FFC contact members 206.

Figure 3A:
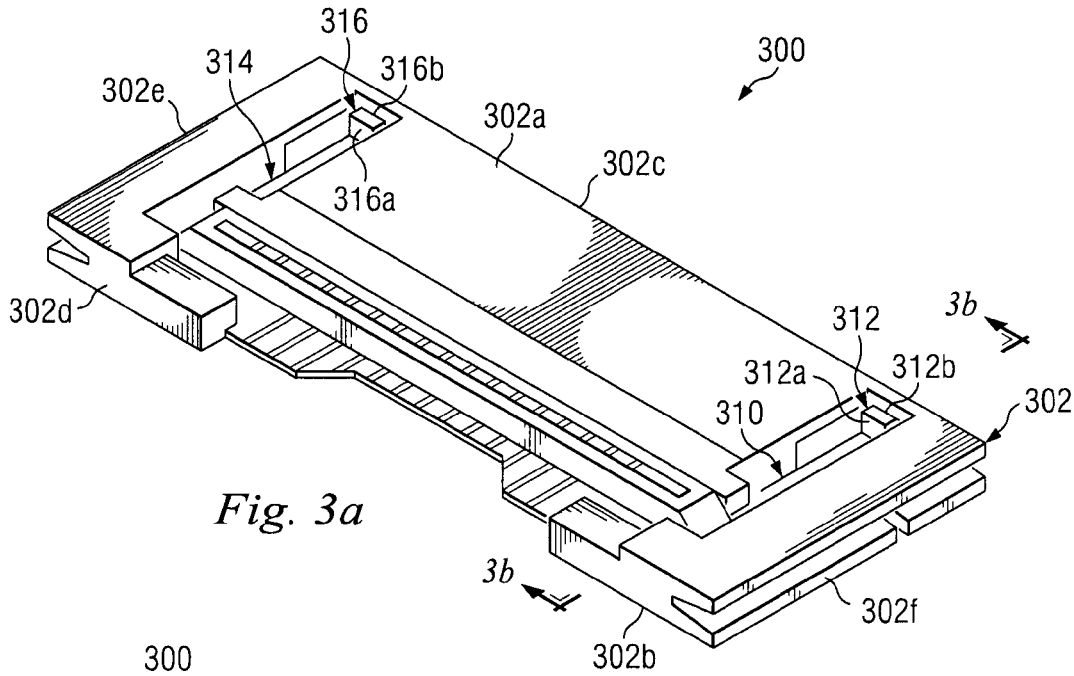
FIG. 3*a* is a perspective view illustrating an embodiment of an LIF connector used with the cable of FIGS. 2*a* and 2*b*.
Figure 3B:
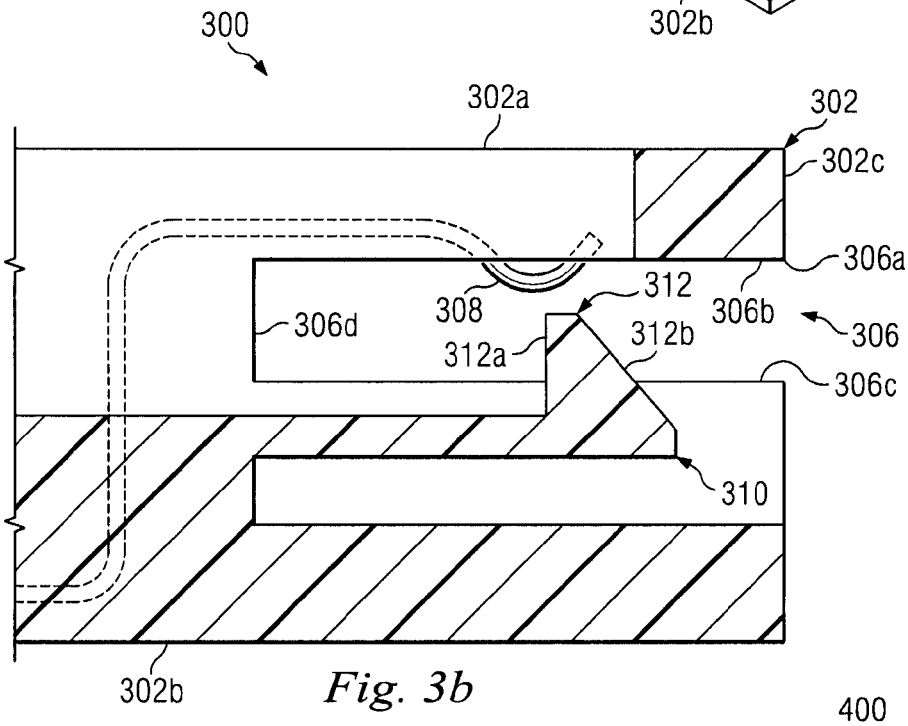
FIG. 3*b* is a cross sectional view illustrating an embodiment of the LIF connector of FIG. 3*a*.

Referring now to FIGS. 3*a* and 3*b*, an LIF connector 300 is illustrated. The LIF connector 300 includes an LIF connector body 302 having a top surface 302*a*, a bottom surface 302*b* located opposite the top surface 302*a*, a front edge 302*c* extending from the top surface 302*a* and bottom surface 302*b*, a rear edge 302*d* located opposite the front edge 302*c* and extending between the top surface 302*a* and bottom surface 302*b*, and a pair of opposing side edges 302*e* and 302*f* extending between the top surface 302*a*, the bottom surface 302*b*, the front edge 302*c*, and the rear edge 302*d*. A cable channel 306 is defined by the LIF connector body 302 and extends into the LIF connector body 302 from a channel entrance 306*a* located on the front edge 302*c*. The cable channel 306 is defined by a channel top surface 306*b*, a channel bottom surface 306*c* located opposite the channel top surface 306*b*, and a channel rear surface 306*d* extending between the channel top surface 306*b* and the channel bottom surface 306*c*.

A plurality of LIF connector contact members 308 are shown located on the LIF connector body 302 adjacent the cable channel 306. The LIF connector contact members 308 run through the LIF connector body 302 and extend into the cable channel 306 adjacent the channel top surface 306*b*, as illustrated. In an embodiment, the plurality of LIF connector contact members 308 may be located in different positions other than what is illustrated, such as, for example, adjacent the channel bottom surface 306*c* or adjacent the channel rear surface 306*d*. While the LIF connector contact members 308 are shown extending into the cable channel 306, in an embodiment, the LIF connector contact members 308 may be flush with the top surface 306*b* of the cable channel 306 without actually extending into the cable channel 306.

A first cable securing member 310 extends from the LIF connector body 302 and is located adjacent the cable channel 306. A first coupling portion 312 is located on a distal end of the first cable securing member 310. The first coupling portion 312 includes a first securing surface 312*a* and a first beveled edge 312*b* located adjacent the first securing surface 312*a*. A second cable securing member 314 extends from the LIF connector body 302 and is located adjacent the cable channel 306 on an opposite side of the plurality of LIF connector contact members 308 from the first cable securing member 310. The second cable securing member 314 is a flexible beam extending from the LIF connector body 302. A second coupling portion 316 is located on a distal end of the second cable securing member 314. The second coupling portion 316 includes a second securing surface 316*a* and a second beveled edge 316*b* located adjacent the second securing surface 316*a*. In an embodiment, the first cable securing member 310 may be the only cable securing member located on the LIF connector body 302. In an embodiment, the first cable securing member 310 may be located in different positions other than what is illustrated, such as, for example, between two LIF connector contact members 308.

Referring now to FIGS. 2*a*, 2*b*, 3*a*, 3*b*, 4*a*, 4*b*, 4*c*, 4*d* and 4*e*, a method 400 for securing an LIF connector is illustrated. The method 400 begins at step 402 where the LIF connector 300, illustrated in FIGS. 3*a* and 3*b*, is provided. In an embodiment, the LIF connector 300 may be coupled to an IHS 100, described above with reference to FIG. 1, on a board located in the chassis 116, described above with reference to FIG. 1, such that the LIF connector 300 is electrically coupled to the processor 102, described above with reference to FIG. 1.

Figure 4A:
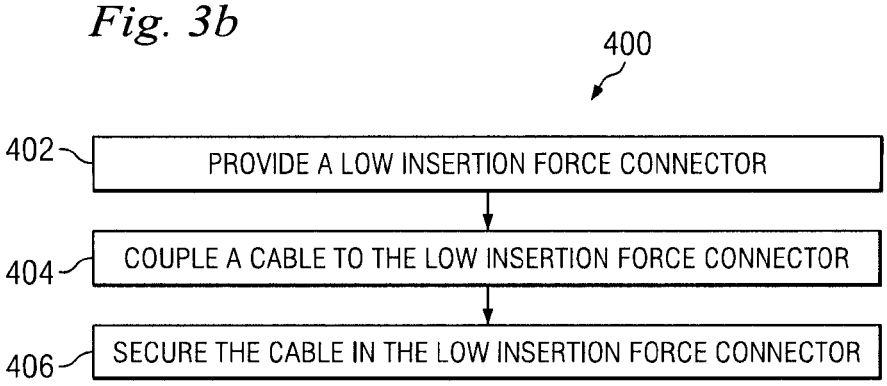
FIG. 4*a* is a flow chart illustrating an embodiment of a method for coupling a cable to an LIF connector.
Figure 4B:
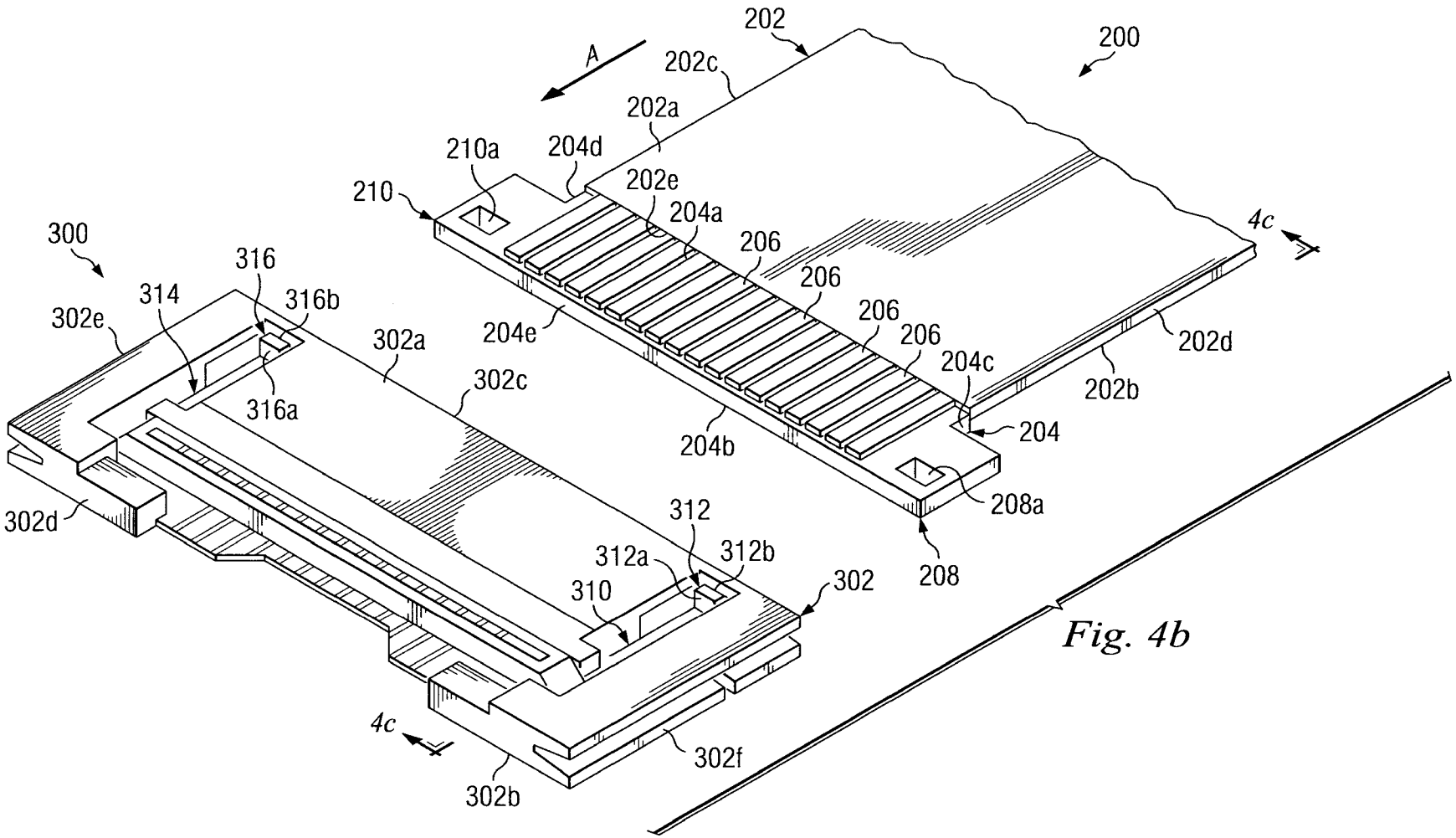
FIG. 4*b* is a perspective view illustrating an embodiment of the cable of FIGS. 2*a* and 2*b* being coupled to the LIF connector of FIGS. 3*a* and 3*b*.
Figure 4C:
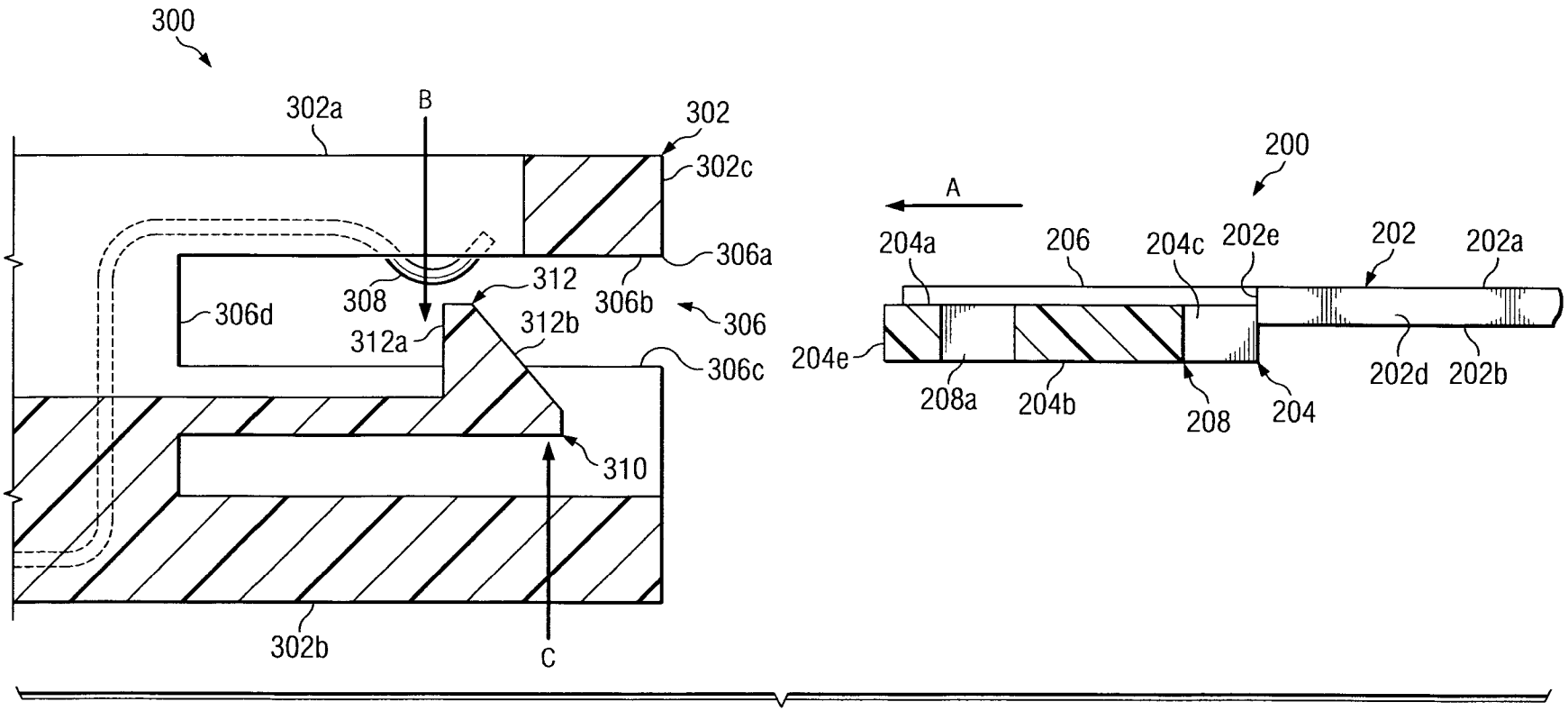
FIG. 4*c* is a cross sectional view illustrating an embodiment of the cable of FIGS. 2*a* and 2*b* being coupled to the LIF connector of FIGS. 3*a* and 3*b*.

The method 400 then proceeds to step 404 where the cable 200, illustrated in FIGS. 2*a* and 2*b*, is coupled to the LIF connector 300. The cable 200 is positioned adjacent the LIF connector 300 such that the front edge of the substrate 204*e* is located adjacent the cable channel 306, as illustrated in FIGS. 4*b* and 4*c*. The cable 200 is then moved in a direction A such that the substrate 204 enters the cable channel 306. As the substrate 204 enters the cable channel 306 the plurality of LIF connector contact members 308 engage the plurality of FFC contact members 206.

Figure 4D:
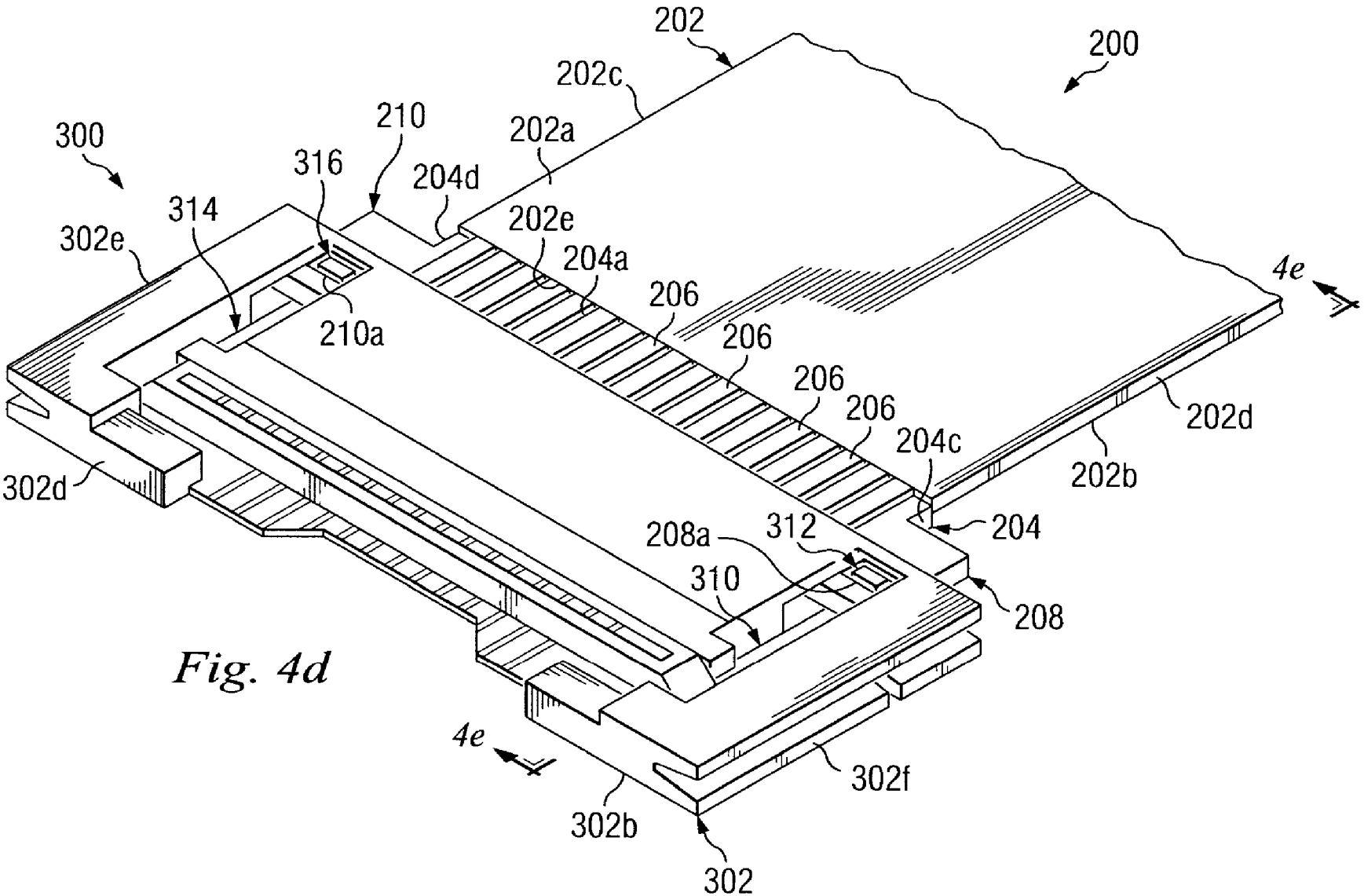
FIG. 4*d* is a perspective view illustrating an embodiment of the cable of FIGS. 2*a* and 2*b* coupled to the LIF connector of FIGS. 3*a* and 3*b*.
Figure 4E:
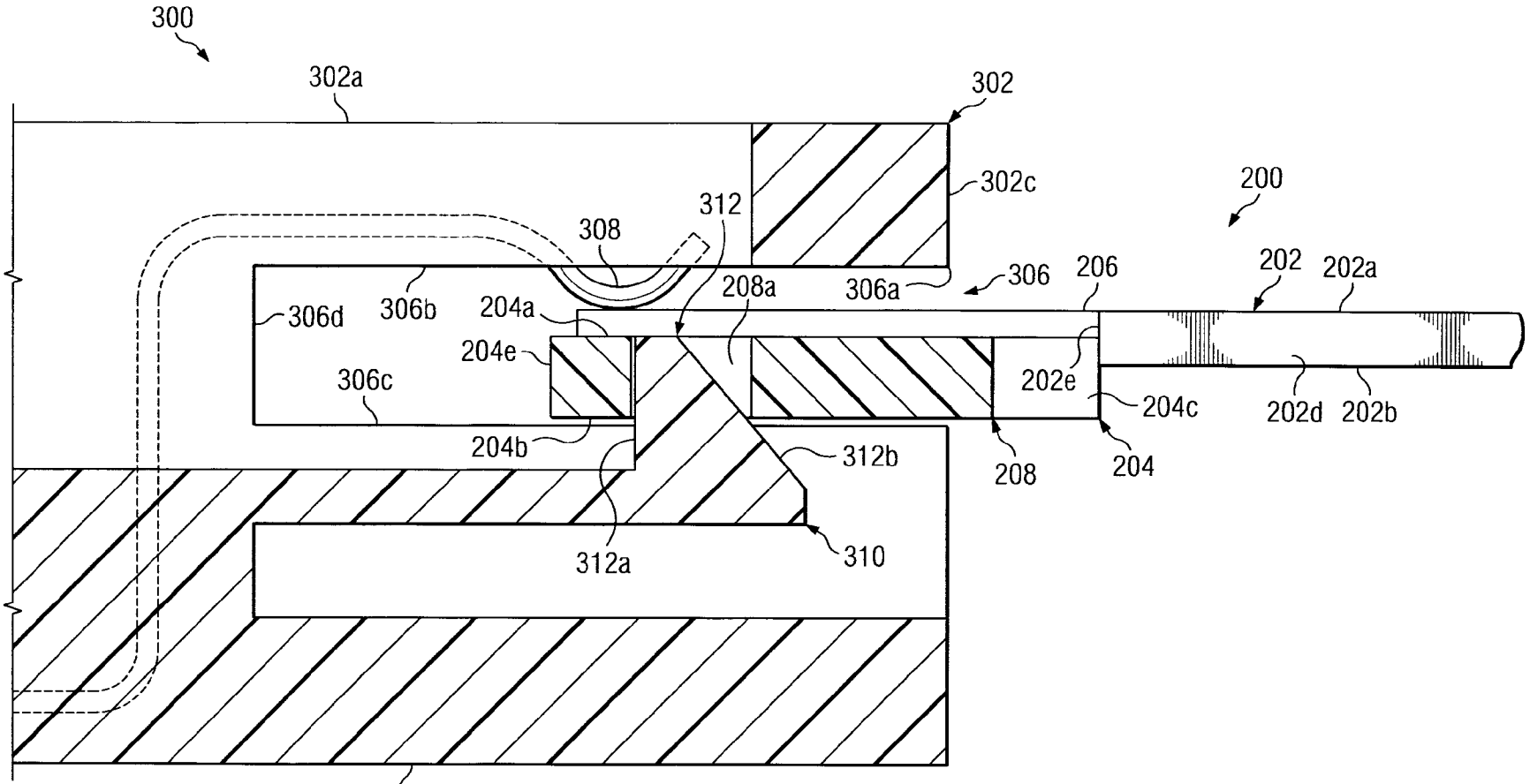
FIG. 4*e* is a cross sectional view illustrating an embodiment of the cable of FIGS. 2*a* and 2*b* coupled to the LIF connector of FIGS. 3*a* and 3*b*.

The method 400 then proceeds to step 406 where the cable 200 is secured to the LIF connector 300. As the substrate 204 continues to move in direction A, the substrate 204 engages the first beveled edge 312*b* of the first cable securing member 310. Engagement of the substrate 204 with the first beveled edge 312*b* on the first cable securing member 310 deflects the first cable securing member 310 in a direction B such that the substrate 204 may continue to move in a direction A until the first cable securing member 310 is allowed to resiliently deflect in a direction C into the first aperture 208*a* such that the first securing surface 312*a* engages the first aperture 208*a*, as illustrated in FIGS. 4*d* and 4*e*. When the first securing surface 312*a* engages the first aperture 208*a*, the plurality of FFC contact members 206 may not be disengaged from the plurality of LIF connector contact members 308 without the first coupling portion 312 on the first cable securing member 310 being removed from the first aperture 208*a* such that the first securing surface 312*a* disengages the first cable coupling member 208. In an embodiment, the second cable coupling member 210 may couple to the second cable securing member 314 in substantially the same manner as described above for the first cable coupling member 208 and the first cable securing member 310. Thus, a method and apparatus are provided that allow a cable to be coupled to an LIF connector such that a plurality of contact members on the cable may not be disengaged from a plurality of LIF connector contact members without disengagement of a cable securing member and a cable coupling member. The method and apparatus are applicable for use in an IHS.

Figure 5A:
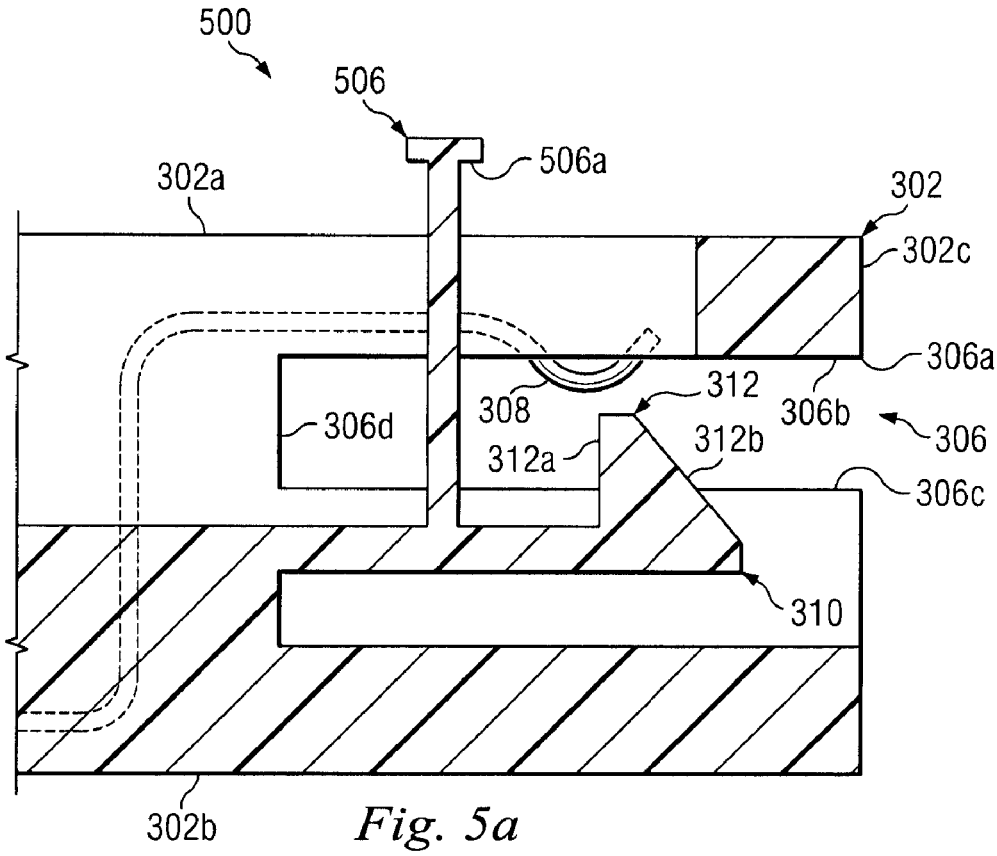
FIG. 5*a* is a cross sectional view illustrating an alternative embodiment of an LIF connector.

Referring now to FIG. 5*a*, in an alternative embodiment, a LIF connector 500 is substantially similar in design and operation to the LIF connector 300, described above with reference to FIGS. 3*a*, 3*b*, 4*a*, 4*b*, 4*c*, 4*d* and 4*e*, with the provision of a first cable securing member disengagement device 506 extending substantially perpendicularly from the first cable securing member 310. The first cable securing member disengagement device 506 includes a handle 506*a* located on its distal end.

Figure 5B:
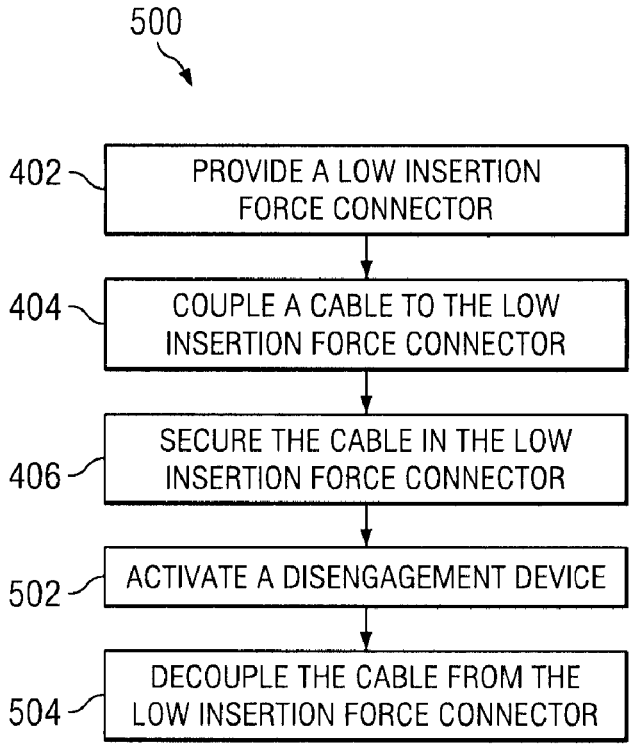
FIG. 5*b* is a flow chart illustrating an alternative embodiment of a method for coupling a cable to an LIF connector.
Figure 5C:
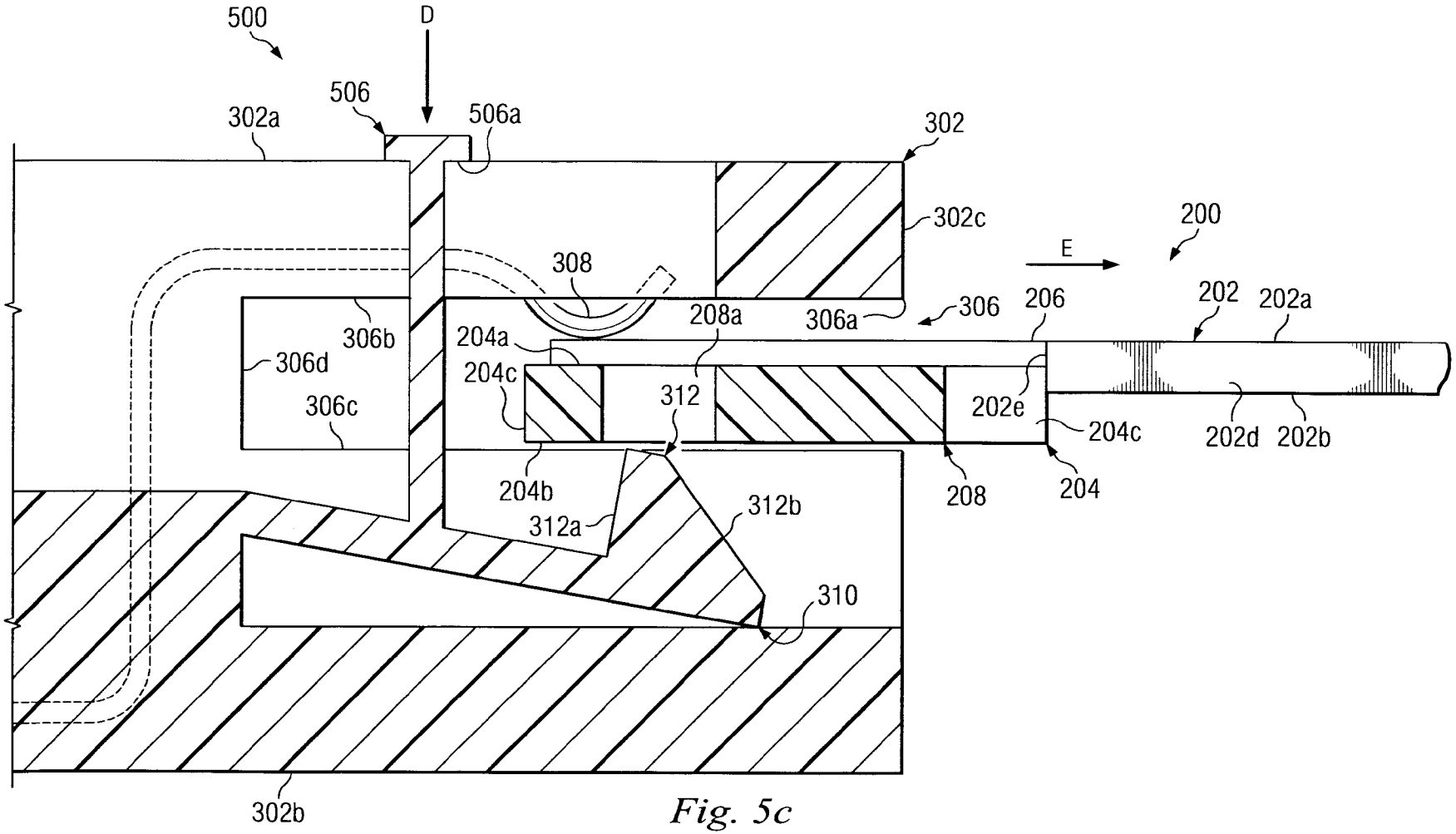
FIG. 5*c* is a cross sectional view illustrating an embodiment of the cable of FIGS. 2*a* and 2*b* being coupled to the LIF connector of FIG. 5*a*.

Referring now to FIGS. 5*b* and 5*c*, a method 500 for coupling a cable to an LIF connector is substantially similar in operation to the method 400, described above with reference to FIGS. 4*a*, 4*b*, 4*c*, 4*d* and 4*e*, with the provision of steps 502 and 504 following step 406. After the cable 200 has been secured, the method 500 proceeds to step 502 where the first cable securing member disengagement device 506 is activated. A force is applied to the handle 506*a* of the first cable securing member disengagement device 506 in a direction D to deflect the first cable securing member 310 such that the first coupling portion 312 is removed from the first aperture 208*a* and the cable 200 may be moved in a direction E, as illustrated in FIG. 5*c*. The method 500 then proceeds to step 504 where the cable 200 is decoupled from the LIF connector 300 by moving the cable 200 in the direction E such that the substrate 204 exits the cable channel 306. In an embodiment, the first cable securing member 310 and the first cable securing member disengagement device 506 may be two separate members operable to engage each other to deflect the first cable securing member in order to disengage the first cable securing member 310 from the cable 200. In an embodiment, a second cable securing member disengagement device may be provided to deflect the second cable securing member 314, illustrated in FIGS. 3*a*, 4*b* and 4*d*. Thus, a method and apparatus are provided for coupling a cable to an LIF connector such that a plurality of contact members on the cable may not be disengaged from a plurality of LIF connector contact members without disengagement of a cable securing member and a cable coupling member. The method and apparatus are applicable for use in an IHS.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A low insertion force connector coupling apparatus, comprising:

a low insertion force connector body comprising a first cable securing member that extends as a first flexible beam from a wall on the low insertion force connector body and includes a coupling portion on a distal end of the first flexible beam opposite the wall;

a cable channel defined by the low insertion force connector body, wherein the first cable securing member is located adjacent the cable channel; and a plurality of low insertion force connector contact members located on the low insertion force connector body adjacent the cable channel;

wherein the coupling portion on the first cable securing member is operable in a single operation, to automatically engage and secure a cable coupling member on a cable such that a plurality of flat flexible cable contact members on the cable may not be disengaged from the plurality of low insertion force connector contact members, and urge the plurality of cable contact members into contact with the plurality of low insertion force connector contact members, and wherein the coupling portion comprises a beveled surface that is operable to be engaged by the cable to deflect the first flexible beam and allow the coupling portion to engage the cable coupling member.

2. The apparatus of claim 1, further comprising:

a first cable securing member disengagement device operable to disengage the first cable securing member and a cable coupling member.

3. The apparatus of claim 1, wherein the first flexible beam of the first cable securing member is resiliently biased in a first position such that the engagement of the cable and the coupling portion deflects the first flexible beam out of the first position, and wherein the resilient return of the first flexible beam to the first position results in the engagement of the coupling portion and the cable coupling member and the securing of the cable in the low insertion force connector body.

4. The apparatus of claim 1, further comprising:

a flat flexible cable operable to couple to the low insertion force connector body, the flat flexible cable comprising a substrate located on a distal end of the flat flexible cable and operable to be positioned in the cable channel;

a plurality of flat flexible cable contact members located on the substrate and operable to engage the plurality of low insertion force contact members when the substrate is positioned in the cable channel; and a first cable coupling member defined by the substrate, whereby the first cable coupling member is operable to engage the first cable securing member when the substrate is positioned in the cable channel such that the plurality of flat flexible cable contact members may not be disengaged from the plurality of low insertion force contact members without disengaging the first cable securing member and the first cable coupling member.

5. The apparatus of claim 1, further comprising:

a second cable securing member located adjacent the cable channel, wherein the first cable securing member is located on an opposite side of the plurality of low insertion force connector contact members from the second cable securing member.

6. The apparatus of claim 5, further comprising:

a second cable securing member disengagement device operable to disengage of the second cable securing member and a cable coupling member.

7. The apparatus of claim 5, wherein the second cable securing member extends as a second flexible beam from a wall on the low insertion force connector body and includes a coupling portion on a distal end of the second flexible beam opposite the wall.

8. An information handling system, comprising:

an information handling system chassis;

a processor mounted in the chassis; and a low insertion force connector electrically coupled to the processor, the low insertion force connector comprising:

a low insertion force connector body comprising a first cable securing member that extends as a first flexible beam from a wall on the low insertion force connector body and includes a coupling portion on a distal end of the first flexible beam opposite the wall;

a cable channel defined by the low insertion force connector body, wherein the first cable securing member is located adjacent the cable channel; and a plurality of low insertion force connector contact members located on the low insertion force connector body adjacent the cable channel;

wherein the coupling portion on the first cable securing member is operable in a single operation, to automatically engage a cable coupling member on a cable such that a plurality of flat flexible cable contact members on the cable may not be disengaged from the plurality of low insertion force connector contact members, and urge the plurality of cable contact members into contact with the plurality of low insertion force connector contact members, and wherein the coupling portion comprises a beveled surface that is operable to be engaged by the cable to deflect the first flexible beam and allow the coupling portion to engage the cable coupling member.

9. The system of claim 8, further comprising:

a first cable securing member disengagement device operable to disengage the first cable securing member and a cable coupling member.

10. The system of claim 8, wherein the first flexible beam of the first cable securing member is resiliently biased in a first position such that the engagement of the cable and the coupling portion deflects the first flexible beam out of the first position, and wherein the resilient return of the first flexible beam to the first position results in the engagement of the coupling portion and the cable coupling member and the securing of the cable in the low insertion force connector body.

11. The system of claim 8, further comprising:

a flat flexible cable coupled to the low insertion force connector body, the flat flexible cable comprising a substrate located on a distal end of the flat flexible cable and positioned in the cable channel;

a plurality of flat flexible cable contact members located on the substrate and engaging the plurality of low insertion force connector contact members; and a first cable coupling member defined by the substrate, whereby the first cable coupling member engages the first cable securing member such that the plurality of flat flexible cable contact members may not be disengaged from the plurality of low insertion force connector contact members without disengaging the first cable securing member and the first cable connecting member.

12. The system of claim 8, further comprising:

a second cable securing member located adjacent the cable channel, wherein the first cable securing member is located on an opposite side of the plurality of low insertion force connector contact members from the second securing member.

13. The system of claim 12, further comprising:

a second cable securing member disengagement device operable to disengage of the second cable securing member and a cable coupling member.

14. The system of claim 12, wherein the second cable securing member extends as a second flexible beam from a wall on the low insertion force connector body and includes a coupling portion on a distal end of the second flexible beam opposite the wall.

15. A method for securing a cable to a low insertion force connector, comprising:

providing a low insertion force connector defining a cable channel and comprising a plurality of low insertion force connector contact members adjacent the cable channel and a cable securing member extending as a flexible beam from a wall of the low insertion force connector and including a coupling portion that is located on a distal end of the flexible beam opposite the wall and adjacent the cable channel;

coupling a cable to the low insertion force connector by positioning the cable in the cable channel; and in a single operation, automatically securing the cable in the low insertion force connector by engaging the coupling portion on the cable securing member with a cable coupling member located on the cable, wherein the securing the cable in the low insertion force connector comprises deflecting the flexible beam from a first position in which the flexible beam is resiliently biased and then allowing the flexible beam to resiliently return to the first position such that the coupling portion engages the cable coupling member, secures the cable in the low insertion force connector and urges a plurality of cable contact members on the cable into contact with the plurality of low insertion force connector contact members.

16. The method of claim 15, further comprising:

activating a disengagement device to disengage the cable securing member and the cable coupling member; and decoupling the cable from the low insertion force connector.

17. The method of claim 15, whereby the securing the cable in the low insertion force connector comprises preventing the plurality of low insertion force connector contact members from disengaging a plurality of flat flexible cable contact members on the cable.

18. A low insertion force connector coupling apparatus, comprising:

a low insertion force connector body comprising a cable securing member that extends as a flexible beam from a wall on the low insertion force connector body and includes a coupling portion on a distal end of the flexible beam opposite the wall;

a cable channel defined by the low insertion force connector body, wherein the cable securing member is located adjacent the cable channel; and a plurality of low insertion force connector contact members located on the low insertion force connector body adjacent the cable channel;

wherein the cable securing member is operable, in a single operation, to automatically secure an associated cable by resiliently deflecting the flexible beam from a first position to allow the insertion of the associated cable into the cable channel and then allowing the flexible beam to resiliently return to the first position to secure the associated cable in the cable channel and urge a plurality of cable contact members on the cable into contact with the plurality of low insertion force connecter contact members.

* * * * *